US007183997B1

(12) United States Patent
Eakes et al.

(10) Patent No.: US 7,183,997 B1
(45) Date of Patent: Feb. 27, 2007

(54) SATELLITE DISH LOCATION DEVICE

(76) Inventors: James E. Eakes, 803 Francis Dr., Jackson, MO (US) 63755; Mark Jackson, 1828 La Mesa, Cape Girardeau, MO (US) 63701

( * ) Notice: Subject to any disclaimer, the term of this patent is extended or adjusted under 35 U.S.C. 154(b) by 227 days.

(21) Appl. No.: 10/944,342

(22) Filed: Sep. 20, 2004

(51) Int. Cl.
*H01Q 3/00* (2006.01)

(52) U.S. Cl. ..... 343/894; 343/760; 342/359; 33/348; 33/352

(58) Field of Classification Search ..... 343/760, 343/894, 882; 342/359; 33/348, 352, 270, 33/353
See application file for complete search history.

(56) References Cited

U.S. PATENT DOCUMENTS 4,674,873 A * 6/1987 Zegarski ..... 356/138
5,274,926 A 1/1994 Dillon
5,760,739 A 6/1998 Pauli
6,538,613 B1 3/2003 Pursiheimo
6,683,581 B2 1/2004 Matz et al.
2002/0005816 A1 1/2002 Ginther et al.

* cited by examiner

*Primary Examiner*—Michael C. Wimer
(74) *Attorney, Agent, or Firm*—Harpman & Harpman

(57) ABSTRACT

A satellite line of site alignment device for the installation of all satellite dish antenna. The alignment device provides a hand held orientation and angular inclination determination for properly positioning a satellite receiving dish with a known geosynchronous orbiting satellite transmitter. Receiving dish location longitude and latitude, satellite to be aligned to, and true north and level orientation are so configured to provide visually for siting through an eye piece for line of site object avoidance determination prior to satellite dish antenna installation.

8 Claims, 8 Drawing Sheets

SATELLITE DISH LOCATION DEVICE

BACKGROUND OF THE INVENTION

1. Technical Field

This invention relates to satellite dish location and placement devices that are used to properly determine a site for a satellite dish in relation to orbiting satellites in geosynchronous orbit.

2. Description of Prior Art

Prior art devices of this type have relied on a wide variety of alignment and orientation tools for satellite dishes, see for example U.S. Pat. Nos. 5,274,926, 5,760,739, 6,538,613, 6,683,581 and Patent Publication US 2002/0005816 A1.

In U.S. Pat. No. 5,274,926 an antenna aligning instrument is disclosed wherein an earth representational sphere is mounted in a holder with an adjustable ring thereabouts having a scale marked in degrees and a compass level to ascertain the position or orientation in alignment of a satellite dish.

U.S. Pat. No. 5,760,739 defines a method and apparatus for aligning a directional antenna in which an adjustable gnomon is calibrated using fitting information from a companion computer software program.

U.S. Pat. No. 6,538,613 claims a method for aligning a radio antenna using an optical site rather than signal strength and that the antenna be so positioned need not be installed in its place for aiming.

U.S. Pat. No. 6,683,581 is directed to an antenna alignment device having multiple embodiments utilizing affixing the device to the antenna and using a digital compass, level and one embodiment and a sound speaker in another.

Patent Publication US2002/005816 A1 shows a satellite dish antenna alignment device by applying it to the dish mast assembly arm. A bubble level on the arm is used in conjunction with a compass allowing the installer to configure the bracket by location orientation thereof.

SUMMARY OF THE INVENTION

A satellite dish placement device that uses multiple orientation input data in a hand held device to position a line of site eye pieces to a prospective satellite orbital position by axial rotation of the eye piece on a pivoting support arm. Apparatus level and directional indicators are integrated into a support and storage base.

DESCRIPTION OF THE PREFERRED EMBODIMENT

Figure 1:
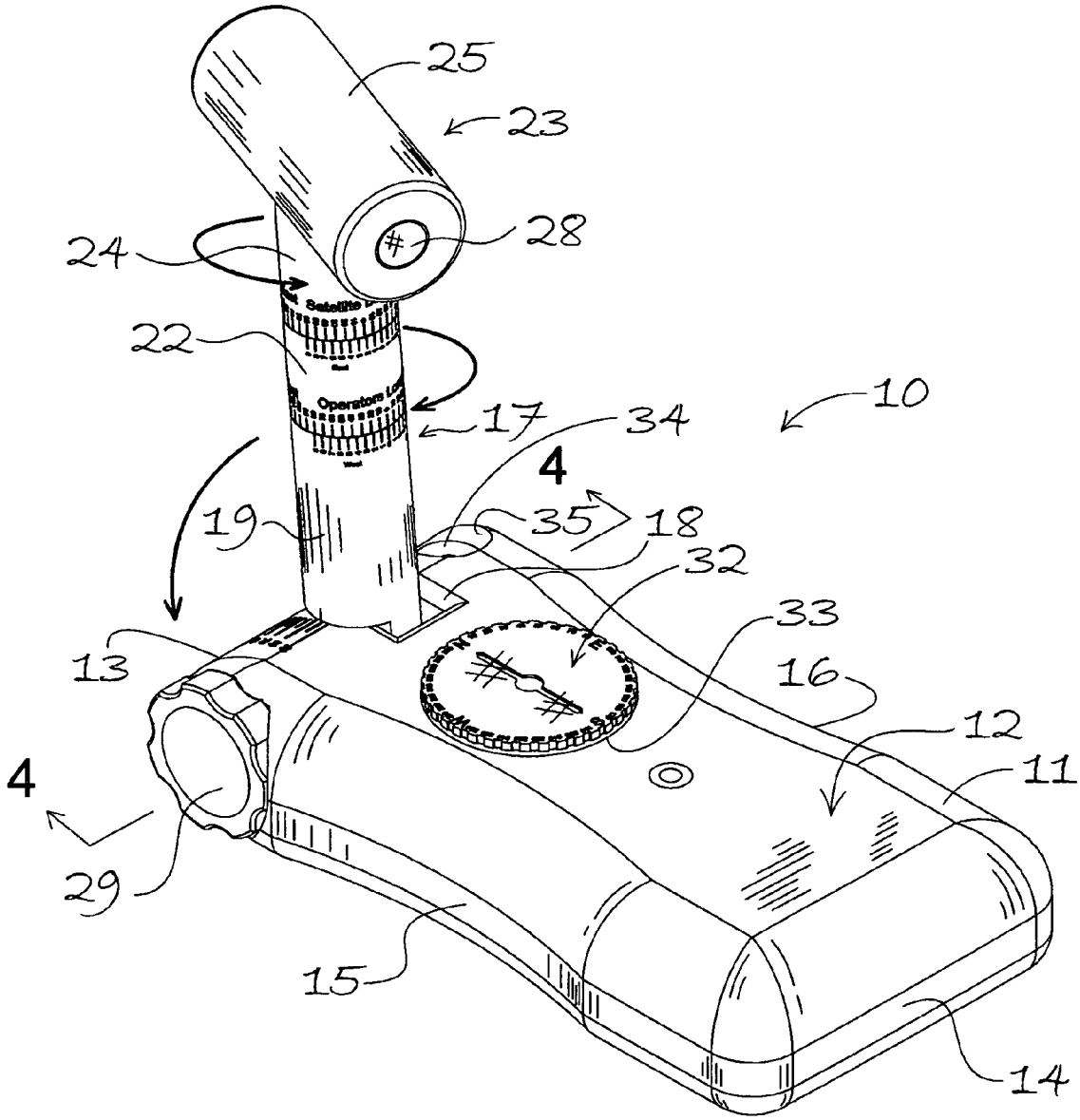
FIG. 1 is a perspective view of the satellite tool with site arm in deployed use position.
Figure 2:
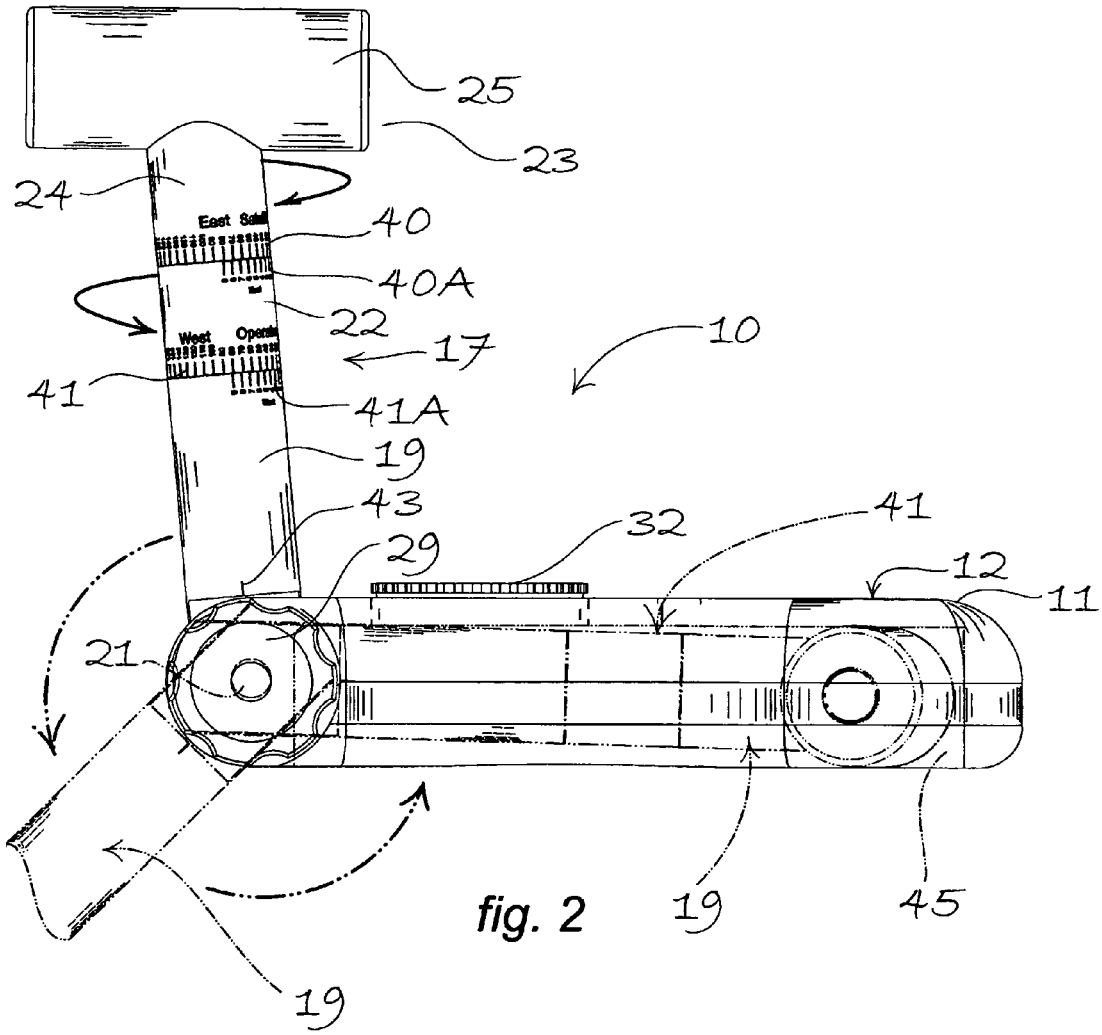
FIG. 2 is a side elevational view with portions shown in broken lines and dotted lines thereof.
Figure 3:
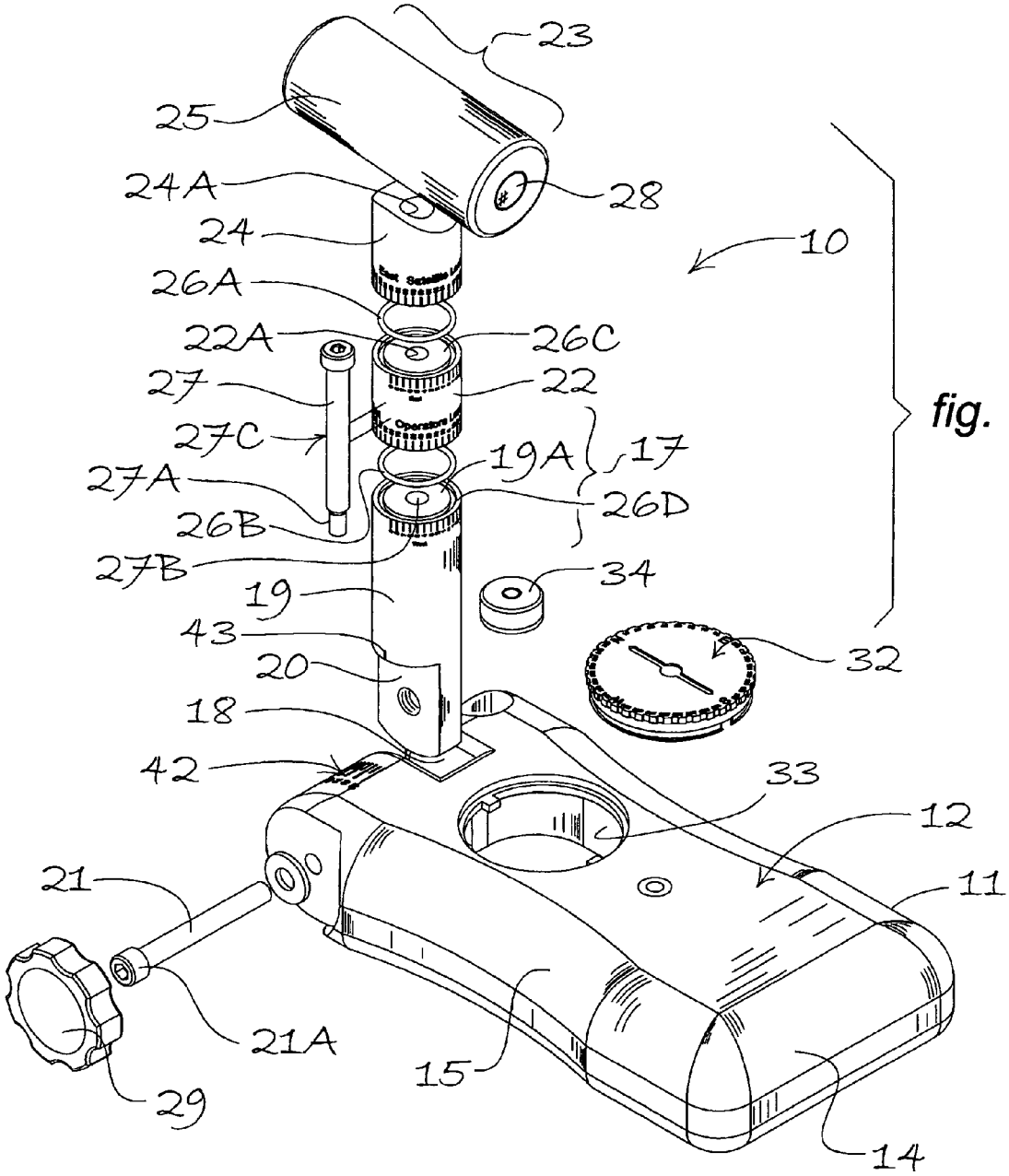
FIG. 3 is an exploded perspective view of the satellite positioning device.

Referring to FIGS. 1–3 of the drawings, a satellite antenna placement device 10 can be seen having a main body member 11 of a generally rectangular configuration having an upper surface 12, oppositely disposed ends 13 and 14 and parallel spaced contoured sidewalls 15 and 16. A multiple adjustable arm assembly 17 is pivotally secured within a recessed mounting notch 18 in the body member end 13. The arm assembly 17 has a cylindrical lower arm portion 19 with an apertured registration mounting area 20 of reduced transverse dimension which is pivotally positioned on an axial adjustable fastener 21 which extends through the mounting notch 18. A central rotatable cylinder portion 22 extends in axial alignment from the free end at 19A of the arm portion 19. An upper arm portion 23 has a rotatable cylinder portion 24 with a transversely mounted site tube 25 thereon. Bearing rings 26A and 26B in associated respective ring seats 26C and 26D are positioned within the respective ends of the cylinder arm portions 19 and 24 for ease of selective rotation thereof as will be understood by those skilled in the art.

Figure 5:
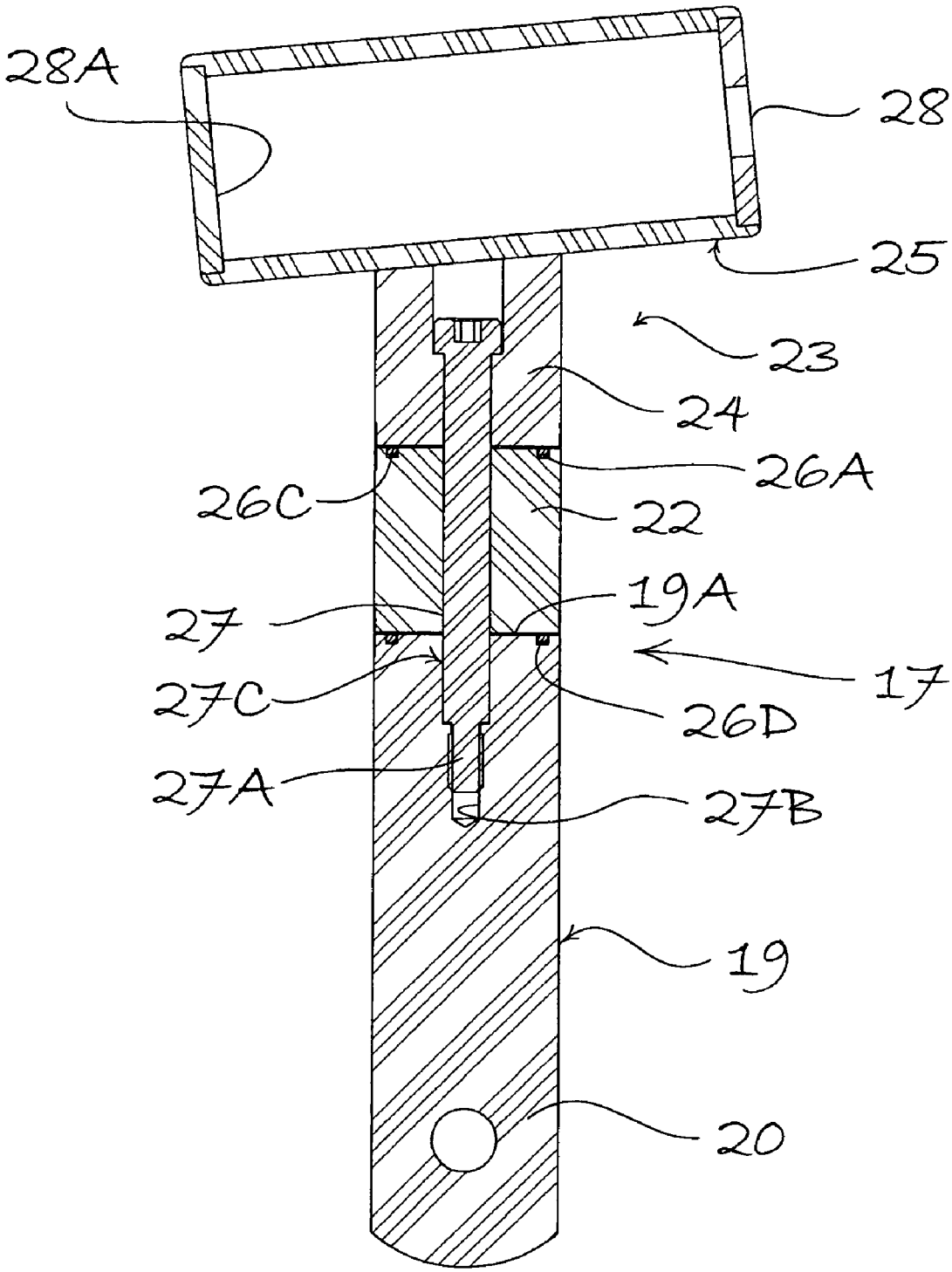
FIG. 5 is a cross-sectional view of the eye piece and support arm independent of the assembly.

An axial arm segment bearing fastener 27 is threadably secured at 27A into a corresponding bore 27B in the lower cylinder arm portion 19 and has a bearing surface 27C registerably aligned through rotational bores 22A and 24A in respective cylindrical portions 22 and 24 as best seen in FIG. 5 of the drawings. It will be evident from the above description that the entire arm assembly 17's vertical angular orientation can be adjusted and the cylindrical portions 22 and 24 can be axially rotated independent of one another and the lower arm portion 19 as will be described in greater detail hereinafter.

The site tube 25 has an eye piece 28 in one end thereof and a lens assembly 28A in oppositely disposed relation thereto in its remaining end.

Figure 4:
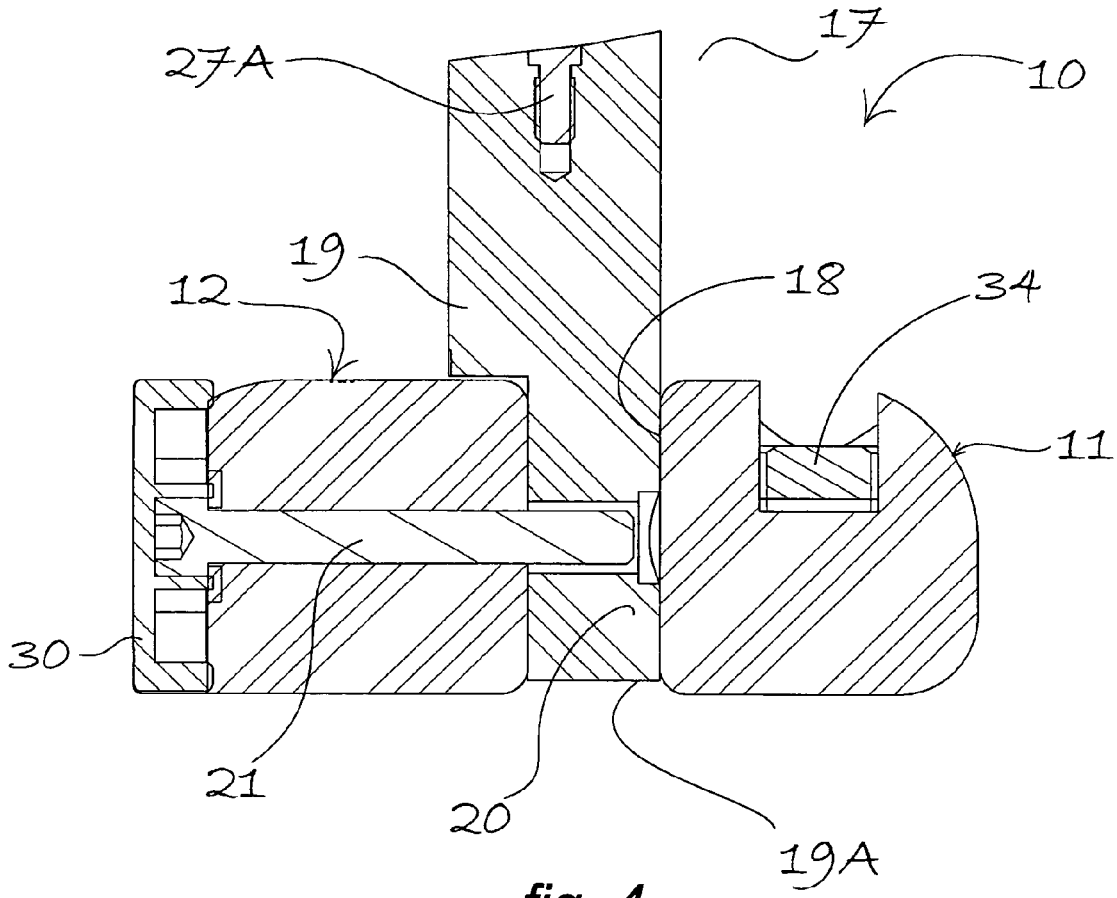
FIG. 4 is a partial cross-sectional view on lines 4—4 of FIG. 1.

Referring now back to FIG. 4 of the drawings, an arm adjustment knob 29 is secured to a projecting end portion 21A of the bearing fastener 21. The adjustment knob 29 transfers rotational input thereon to the bearing fastener 21 which is threadably engaged so as to selectively lock the arm assembly 17 in angular positions in relation to the main body member 11 during use.

Referring now to FIGS. 1–3 of the drawings, a magnetic directional compass 32 can be seen secured within an annular registration opening at 33 in the upper surface 12 of the main body member 11 in spaced relation to the arm notch 18 and arm assembly 17 to provide directional orientation as will be described hereinafter.

A "bubble" type level 34 is also provided, mounted within an annular recess 35 in the end 13 of the main body member 11. By utilization of the satellite positioning device 10 of the invention, proper placement of a satellite receiving dish (not shown) can be determined.

Positioning indicia, comprising sequential number bands for satellite location at 40 and 40A are positioned on adjacent rotatable cylinder portions 24 and 22. Operator location (dish) sequential number bands 41 and 41A for longitudinal input determination are positioned on the respective cylinder portions 22 and 19.

Figure 6:
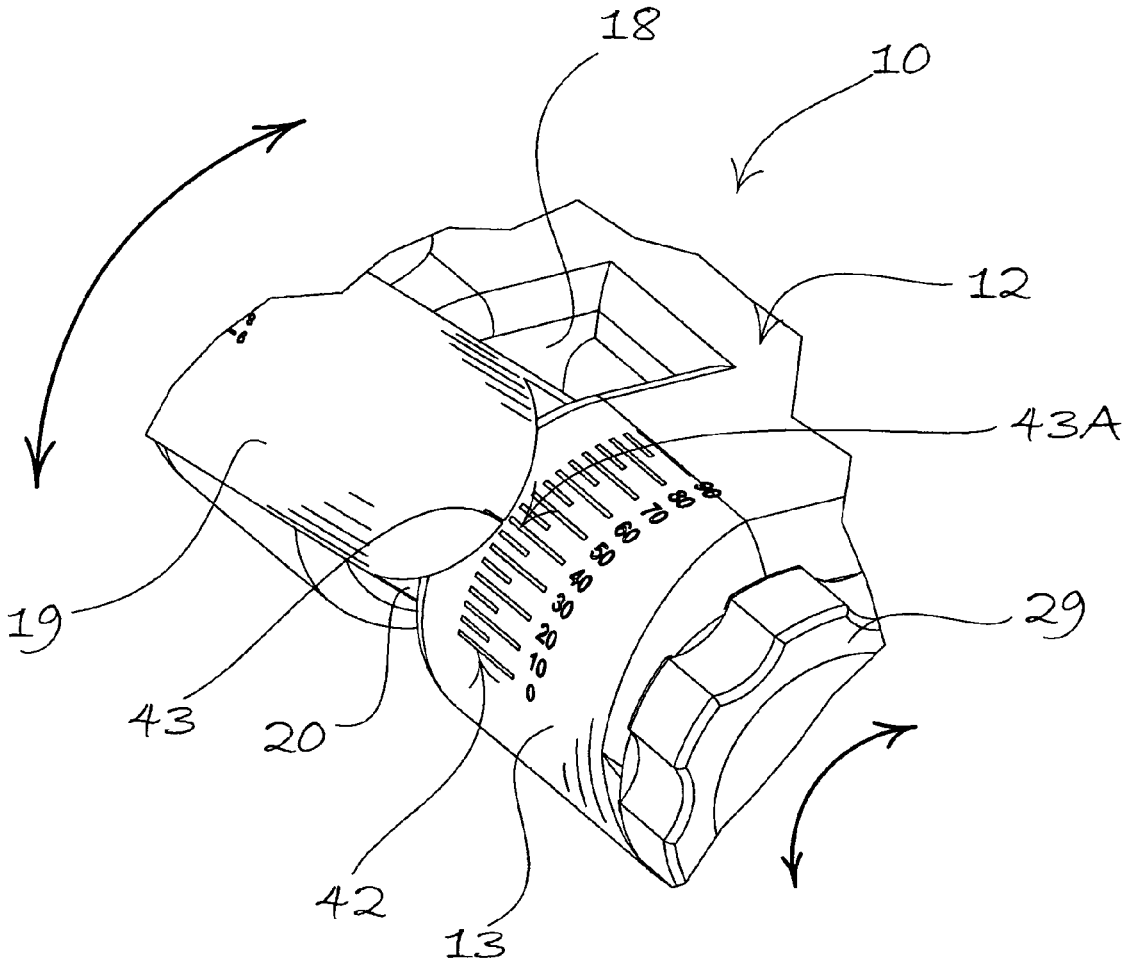
FIG. 6 is an enlarged partial perspective view illustrating pivotal longitudinal arm adjustment features.

An operator's location (dish) latitude indicia numbered band 42 is correspondingly positioned on the end portion 13 of the main body member 11 as best seen in FIGS. 1, 2 and 6 of the drawings which allows for selective orientation of the device as follows.

In actual use, to determine if there is a clear line of site which is critical for positioning of the satellite receiving antenna (dish) (not shown) requires latitude and longitude position of the operator's location. For example, if the operator's location (dish) is determined to be forty degrees latitude and eighty-nine degrees west longitude, corresponding operator location latitude is set by adjusting the angle of the arm portion 19, best seen in FIG. 6 of the drawings by rotating the knob 29 and repositioning the arm's indicator mark at 43 to align with the number indicia forty-two on the end of the main body member 11 illustrated at 43A.

Figure 7:
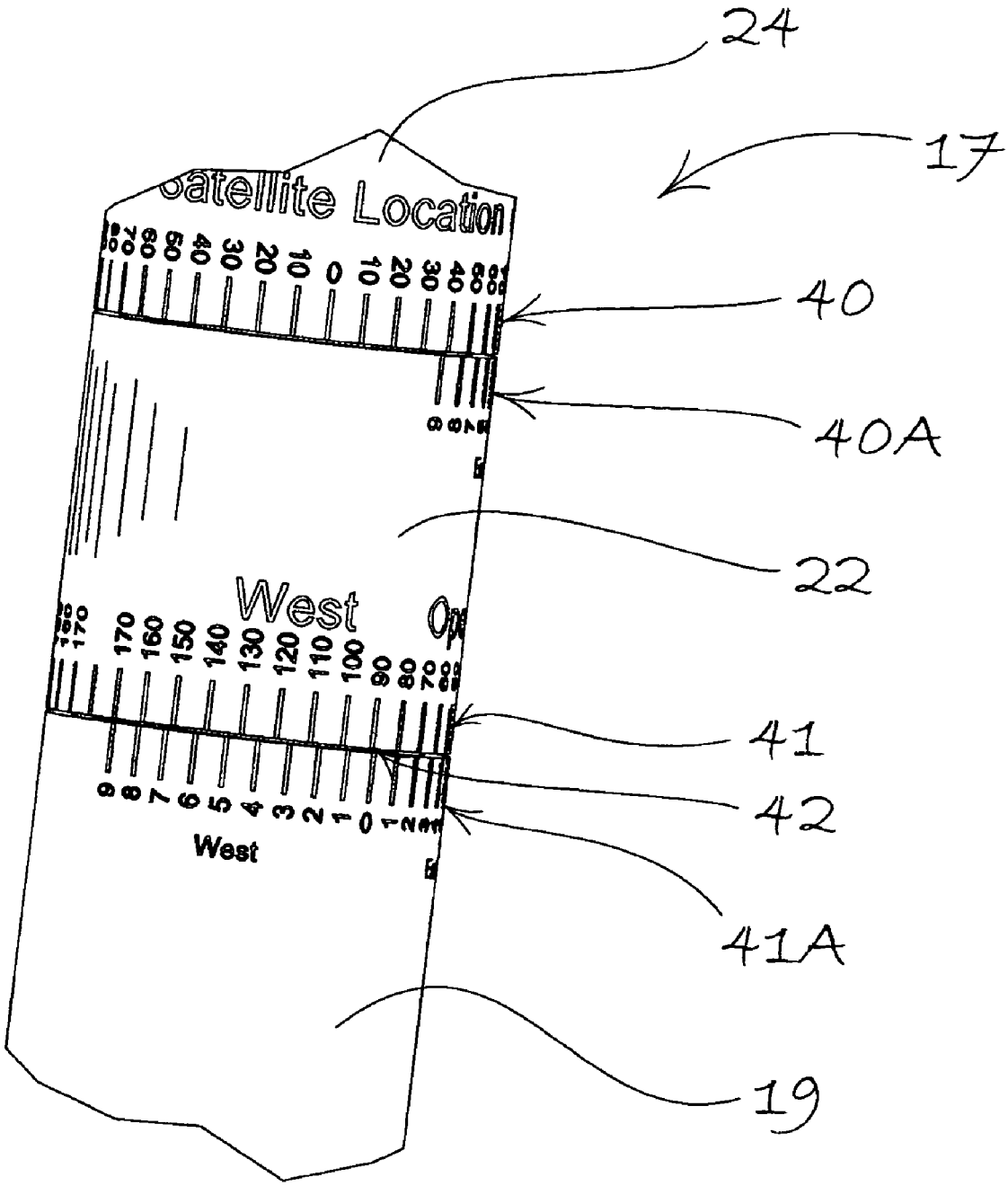
FIG. 7 is an enlarged partial side elevational view of the support arm illustrating operator's longitudinal adjustment input indicia.

The operator's location (dish) longitudinal location of eighty-nine degrees west is set by locating the nearest ten degree mark closest the setting using the number indicia band 41 on cylinder 22 which would be "eighty degrees" and aligning it to the lower indicia number band 41A on the arm 19 to "zero", then continuing turning the cylinder 22 in the same direction until the number indicia indicated as "nine" aligns with the next ten degree mark which would be "one seventy" as seen in FIG. 7 of the drawings.

Figure 8:
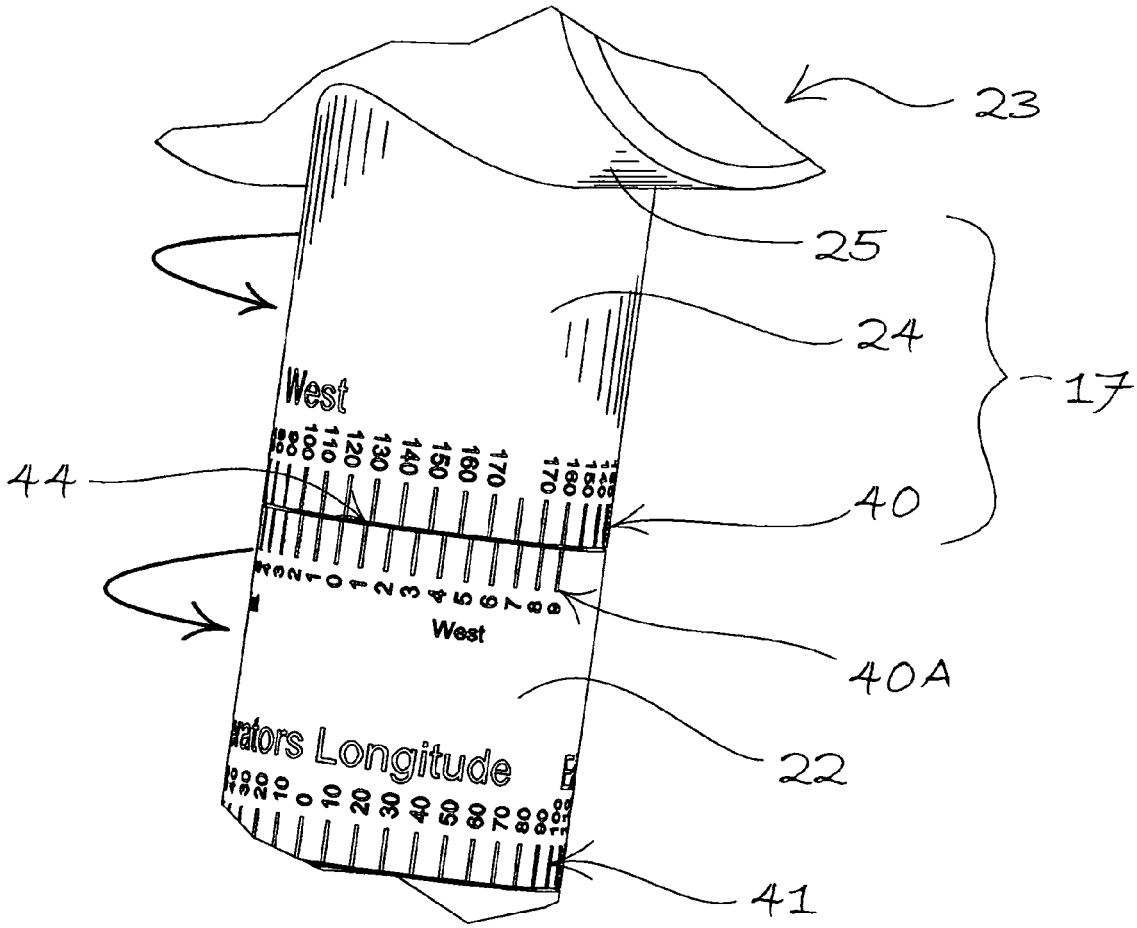
FIG. 8 is an enlarged partial side elevational view of the support arm portion illustrating satellite latitude adjustment input alignment indicia.

In order to set the known orbital satellite location, specifically "longitude" the cylinder 24 is rotated with the attached eye piece 23 as seen in FIG. 8 of the drawings. If, for example, the satellite longitude is one hundred and nineteen degrees west, the cylinder 24 with eye piece 23 is rotated aligning the one hundred and ten degree west indicia number mark thereon with a lower indicia number band 40A to the number "zero", then the cylinder is continued to be turned in the same direction until the nine degree west mark aligns with the next ten degree mark which would be one hundred and twenty as shown at 44 in the drawings.

The orientation of the satellite location device 10 is completed by leveling the main body member 11 by using the bubble level 34 and directionally by use of the built-in compass 32 to the southern sky direction by alignment to true north.

The satellite location device 10 of the invention is placed to emulate the proposed operator's location which is the location of the satellite receiving dish antenna (not shown). The user then visually sites through the siting tube 25 to determine if there are any objects within the site line so indicated. There should be no objects within the site line so indicated for proper placement of the satellite antenna (not shown) which is critical to proper reception which will be well known and understood by those skilled in the art.

After use or for transportation and storage, the knob 29 of the device is rotated allowing the arm 19 to pivot downwardly as indicated by the arrow A in FIG. 2 of the drawings in broken lines and be enclosed up into the storage cavity at 45 that extends inwardly from the base of the main body member 11 shown in dotted lines in FIG. 2 of the drawings. It will be evident that for storage the eye piece 23 and interconnected cylinder 24 must be rotated into a transverse alignment position relative the longitudinal axis of the arm 19 so as to be concealed within the storage cavity 45.

It will be seen that a new and novel satellite antenna location device has been described that can allow the operator to assess before actual installation for proper positioning of a satellite reception antenna assuring the best satellite reception can be obtained by the user.

It will be apparent to those skilled in the art that various changes and modifications may be made therein without departing from the spirit of the invention.

Therefore we claim:

1. An apparatus used by an operator for determining the location of a satellite receiving antenna for a line of site determination comprises, a main body member, a location arm pivotally secured thereto, a level assembly in said main body member, a compass assembly for determining true north in said body member, said location arm having an eye piece positioned on its free end thereof, a first rotatably cylinder portion on said location arm, a second rotatable cylinder portion on said arm abutting said first cylinder portion, sequential numerical indicia on said first and second rotatable cylinder portions and said location arm, said location arm having a reference mark being such that when said location arm is pivotally repositioned, it will align with sequential numerical indicia on said main body member.

2. The apparatus set forth in claim 1 wherein said eye piece and said second rotatable cylindrical portion are affixed to one another.

3. The apparatus set forth in claim 1 wherein said numerical indicia on said first cylindrical portion is in abutting relationship with said numerical indicia on said adjacent second rotatable cylindrical portion and said fixed location arm extending from said main body member.

4. The apparatus set forth in claim 1 wherein said numerical indicia on said second rotatable cylindrical portion and adjacent numerical indicia on said first rotatable cylindrical portion indicates satellite longitude.

5. The apparatus set forth in claim 1 wherein said numerical indicia on said first rotatable cylindrical portion and adjacent numerical indicia on said location arm indicates a longitudinal location of said satellite antenna.

6. The apparatus set forth in claim 1 wherein said reference mark on said location arm and corresponding sequential numerical indicia on said main body member aligned therewith indicates a latitude position of said satellite antenna.

7. The apparatus set forth in claim 1 wherein said main body member has a recessed area there within one end thereof for receiving said location arm.

8. The apparatus set forth in claim 1 whereby in use said location arm is aligned and locked in position defining said operator's latitude, said operator's longitude is set by rotation of said first rotating cylinder portion, a satellite's position is set by rotating said second rotating cylinder portion and attached eye piece to align corresponding numerical indicia therebetween, the main body member is level and oriented for a true north direction and a site line is established by viewing through said eye piece so positioned by rotation of said first and second cylinders and the location arm angle.

* * * * *